United States Patent [19]

Suffridge

[11] Patent Number: 4,922,716

[45] Date of Patent: May 8, 1990

[54] THROTTLED EXHAUST OUTLET TO RESERVOIR FOR REDUCING NOISE RESULTING FROM RELEASE HYDRAULIC PRESSURE SURGES

[75] Inventor: Robert L. Suffridge, Goshen, Ohio

[73] Assignee: Cincinnati Milacron Inc., Cincinnati, Ohio

[21] Appl. No.: 143,649

[22] Filed: Jan. 13, 1988

[51] Int. Cl.[5] ..... B30B 15/18; F15B 21/04

[52] U.S. Cl. ..... 60/378; 91/471; 100/269 R; 251/127; 137/592

[58] Field of Search ..... 91/404-406, 91/471, DIG. 2; 60/378, 461; 137/592; 251/118, 127; 138/103, 178; 100/269 R

[56] References Cited

U.S. PATENT DOCUMENTS

| | | | |
|---|---|---|---|
| 2,193,248 | 3/1940 | Ernst | 60/378 X |
| 2,343,177 | 2/1944 | Flowers | 60/378 X |
| 2,368,769 | 2/1945 | Muller | 60/378 X |
| 2,399,520 | 4/1946 | Tucker | 60/378 X |
| 2,490,625 | 12/1949 | Hall | 91/415 X |
| 2,526,800 | 10/1950 | Brehm et al. | 60/461 |
| 2,544,731 | 3/1951 | Sedgwick | 91/415 X |
| 2,555,115 | 5/1951 | Cizek | 91/517 |
| 2,590,137 | 3/1952 | Towler et al. | 91/451 X |
| 2,602,294 | 7/1952 | Sedgwick | 60/329 |
| 2,614,539 | 10/1952 | Ernst | 60/371 X |
| 2,766,586 | 10/1956 | Towler et al. | 60/378 |
| 2,790,305 | 4/1957 | Towler et al. | 60/375 |
| 2,904,074 | 9/1959 | Towler | 60/378 X |
| 3,599,534 | 8/1971 | Purchon | 60/429 X |
| 3,665,965 | 5/1972 | Baumann | 251/127 X |
| 3,781,160 | 12/1973 | Mankowsky et al. | 425/450.1 |
| 3,899,001 | 8/1975 | Orme | 251/127 X |
| 3,905,742 | 9/1975 | McCarty | 425/451.2 |
| 3,954,124 | 5/1976 | Self | 251/127 X |
| 3,974,764 | 8/1976 | Horton et al. | 100/269 R |
| 3,982,469 | 9/1976 | Bianchetta | 91/484 X |
| 3,987,809 | 10/1976 | Baumann | 251/127 X |
| 3,993,094 | 11/1976 | Spooner | 137/592 X |
| 4,249,574 | 2/1981 | Schnall et al. | 251/127 X |
| 4,397,331 | 8/1983 | Medlar | 251/127 X |
| 4,398,563 | 8/1983 | Kay et al. | 251/127 X |
| 4,530,375 | 7/1985 | Bey | 251/127 X |
| 4,774,984 | 10/1988 | Peters | 251/127 X |

FOREIGN PATENT DOCUMENTS

| | | |
|---|---|---|
| 836400 | 1/1939 | France . |
| 1536140 | 9/1967 | France . |
| 796016 | 6/1958 | United Kingdom . |

*Primary Examiner*—Robert E. Garrett
*Assistant Examiner*—George Kapsalas
*Attorney, Agent, or Firm*—Nies, Kurz, Bergert & Tamburro

[57] ABSTRACT

A method and apparatus for reducing the intensity of the sound that accompanies a rapid decompression in a pressurized hydraulic system such as that of an injection molding machine. The apparatus includes a reduced area valve that interconnects the high pressure system with a low pressure system, with the valve connected with a tubular muffler so that high pressure fluid is initially released through the valve and into the muffler. The muffler includes a plurality of spaced apertures that face a rigid structural surface so that the high pressure fluid passing through the muffler issues from the several apertures and impinges on the rigid structure to dissipate the pressure shock accompanying decompression, and thereby modulate the intensity of the sound of decompression.

13 Claims, 3 Drawing Sheets

THROTTLED EXHAUST OUTLET TO RESERVOIR FOR REDUCING NOISE RESULTING FROM RELEASE HYDRAULIC PRESSURE SURGES

BACKGROUND OF THE INVENTION

1. Field of the Invention

This invention relates to high pressure hydraulic systems and more particularly to apparatus and a method for suppressing the noise associated with pressure surges in high pressure hydraulic systems, such as those in injection molding machines.

2. Description of the Prior Art

In high pressure hydraulic systems, when the hydraulic pressure is released so that high pressure hydraulic fluid can escape to a lower pressure portion of the system, a rapid release of the high pressure frequently results in a surge that causes a cracking-type noise that can have an objectionably high intensity. Although the noise can be reduced by very gradually releasing the high pressure, such a gradual release would undesirably result in significantly longer times for operating cycles for equipment embodying such high pressure systems. Because it is generally desired that hydraulically operated production equipment be operated as rapidly as possible, to permit high volume production of articles such as, for example, molded parts made by an injection molding machine having a hydraulic clamp system, a rapid release of high hydraulic pressure is preferred to provide shorter operating cycle times. However, rapid releases of pressure should be accompanied by a reduction in the sound intensity caused by the pressure reduction, in order to provide an improved work place environment.

Although in the past the use in hydraulic circuits of pilot-operated check valves and counterbalance valves has been suggested in order to reduce the intensity of pressure surges that occur upon release of high pressures, even the use of such valves, which provide slight delays to permit more gradual decompression of the system, still involves undesirable noise when operated at reasonably rapid cycle times that are desired for high volume production.

It is therefore an object of the present invention to provide an hydraulic circuit that permits rapid release and decompression of a high pressure hydraulic fluid, without creating excessive environmental noise.

It is another object of the present invention to provide an improved hydraulic system in which noise can be reduced without the addition of numerous complex and expensive additional valves or additional hydraulic circuitry, which can increase the initial cost of such a system, as well as the operating costs arising from the likelihood of higher maintenance requirements.

SUMMARY OF THE INVENTION

Briefly stated, in accordance with one aspect of the present invention, there is provided a method of reducing the intensity of sound resulting from a rapid release of high hydraulic fluid pressure in a high pressure hydraulic system. The method includes gradually releasing a minor portion of the high pressure fluid in the higher pressure portion of the fluid system to a low pressure portion through a valve communicating with the high pressure system on one side of the valve and communicating with the low pressure system on the other side of the valve. The released fluid is conveyed into a closed chamber positioned in the low pressure side of the system, the closed chamber having a plurality of spaced, small apertures to limit the rate of flow of pressurized fluid from the chamber so that a plurality of small jets of pressurized fluid issue from the chamber. The small jets are directed against a rigid surface that is incapable of deflecting when the jets impinge thereagainst.

In accordance with another aspect of the present invention, apparatus is provided to reduce the sound intensity that results upon sudden release of pressure in a high pressure hydraulic system. The apparatus includes a pressure release valve that provides communication between the high pressure system and the low pressure system. The valve is connected on its downstream side with the low pressure system through a chamber in the form of a conduit that includes a closed end, and that also includes a plurality of longitudinally spaced apertures that provide communication between the interior of the conduit and the low pressure system.

DESCRIPTION OF THE PREFERRED EMBODIMENTS

Figure 1:
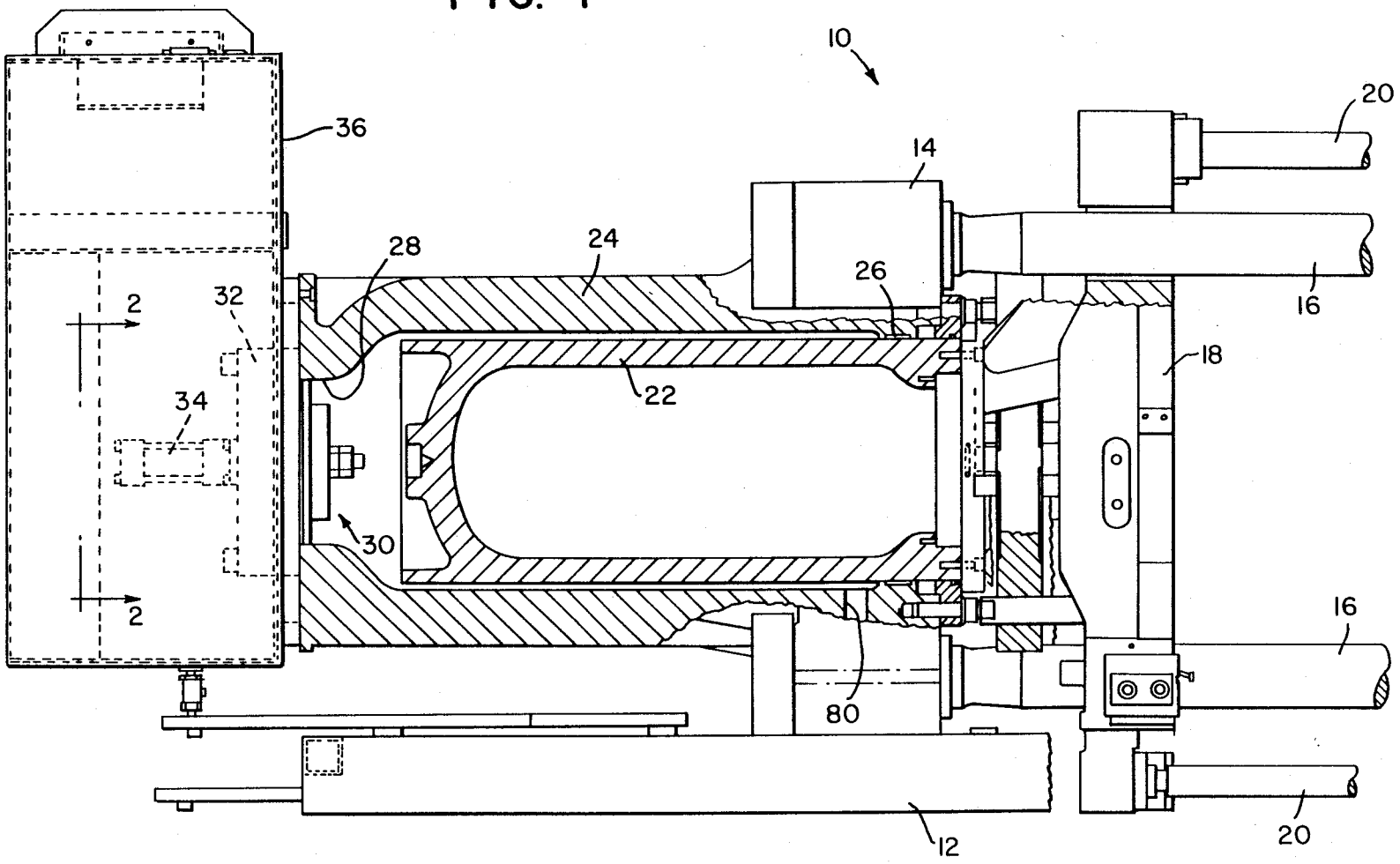
FIG. 1 is a fragmentary view, partially in section, of a portion of a high pressure clamp cylinder for an hydraulically operated plastics injection molding machine having a prefill valve interconnecting the clamp cylinder and a prefill reservoir.
Figure 4:
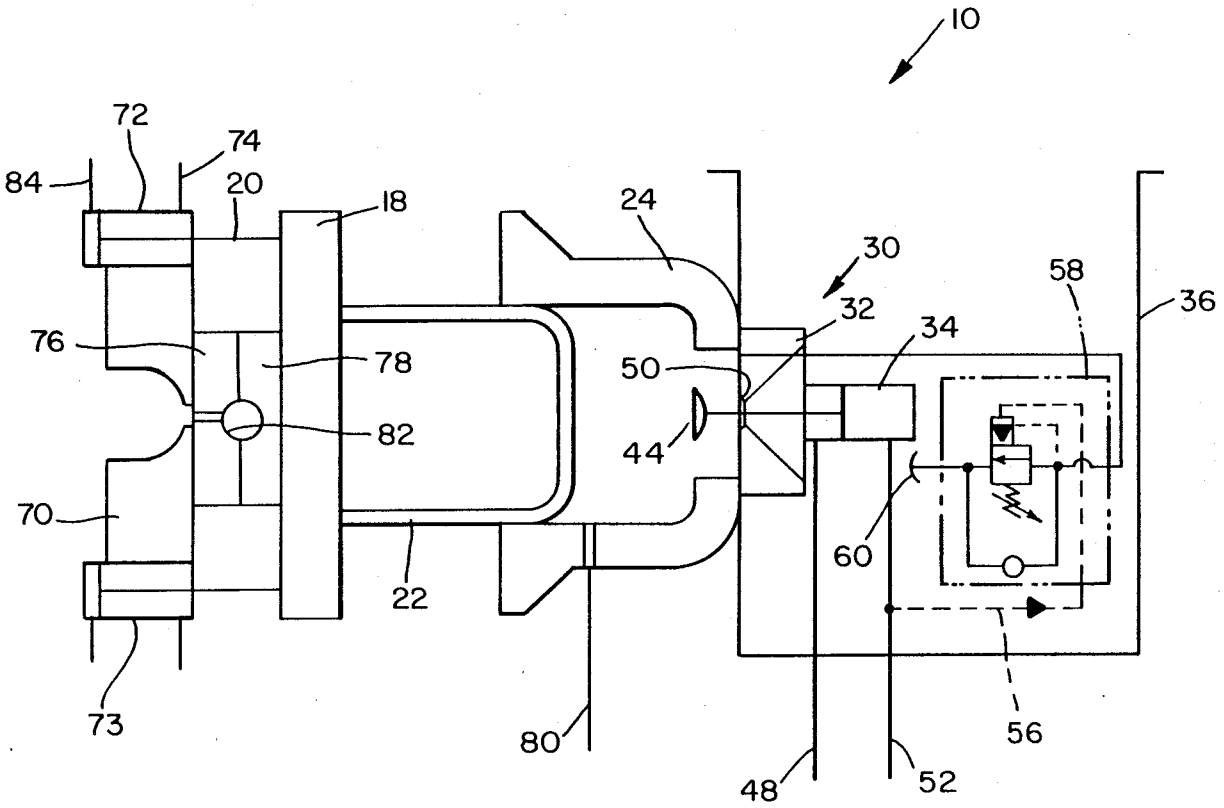
FIG. 4 is a partial circuit diagram showing the hydraulic circuit for the prefill system illustrated in FIGS. 1 through 3.

Referring now to the drawings, and particularly to FIGS. 1 and 4 thereof, there is shown a portion of a plastics injection molding machine 10 in the form of an hydraulic clamp device for moving and clamping together a pair of mold sections 76, 78 (See FIG. 4). The machine includes a base 12 that supports a clamp cylinder 14. Two pairs of parallel guide rods 16 (only two of which are shown in FIG. 1) extend from clamp cylinder 14 and are positioned in a rectangular array. Slidably carried on guide rods 16 is a movable platen 18, which is adapted to carry one mold section 78 (See FIG. 4) and to move that mold section longitudinally along the guide rods toward and away from a fixed platen 70 that supports the cooperating mold section 76 and that is spaced along guide rods 16 from clamp cylinder 14. Movable platen 18 is connected with the rod ends 20 of a pair of diametrically positioned hydraulic cylinders 72, 73 that extend from one face of moving platen 18 and are provided for rapid traverse of movable platen 18 toward and away from the cooperating fixed platen 70 to close and open mold cavity 82 in which molded parts are formed.

Referring once again to FIG. 1, extending from the other side of movable platen 18 from the side from which rod ends 20 extend is a generally cylindrical clamp ram 22 that has a substantially greater cross-sectional area than the sum of the cross-sectional areas of the respective traverse cylinders that provide rapid traverse for movable platen 18. The purpose of clamp ram 22 is to permit the application to movable platen 18 of a very high clamping pressure when the mold sections have been brought into cooperative engagement, as will be explained hereinafter.

Clamp ram 22 is slidably carried in a tubular portion 24 of clamp cylinder 14. Tubular portion 24 includes an inner sealing ring 26 that surrounds and engages the outer surface of clamp ram 22 at the end adjacent to movable platen 18, and the opposite end of clamp cylinder 14 includes a large opening 28 to rapidly admit a large quantity of hydraulic fluid into the cylinder. A prefill valve 30 is positioned in opening 28 for controlling the flow of hydraulic fluid to and from the interior of clamp cylinder 14.

Prefill valve 30 includes a prefill housing 32 that is secured around opening 28 of clamp cylinder 14, and prefill housing 32 carries an actuating cylinder 34 for opening and closing prefill valve 30, as will be hereinafter described. Surrounding the outwardly extending portion of prefill housing 32 and actuating cylinder 34, and secured to clamp cylinder 14 adjacent opening 28, is prefill reservoir 36, the purpose of which is to contain a predetermined amount of hydraulic fluid that passes through prefill valve 30 into the interior of clamp cylinder 24 to fill the clamp cylinder when clamp ram 22 is in its rightmost position, as viewed in FIG. 1.

Figure 2:
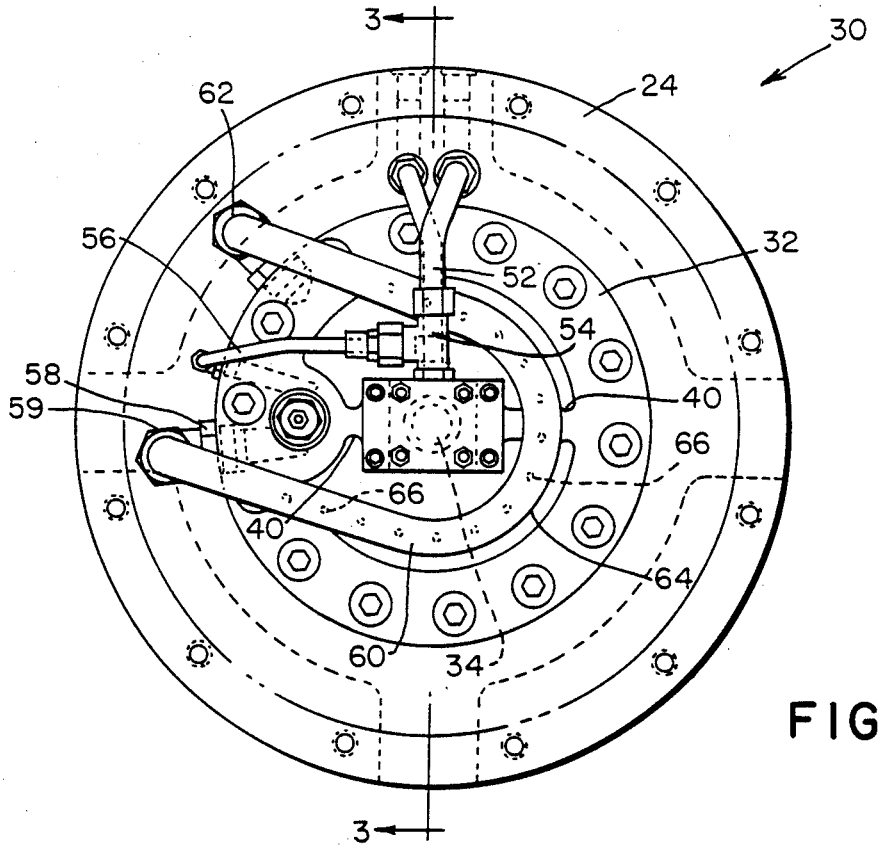
FIG. 2 is an end view of the prefill valve housing shown in FIG. 1, taken along the line 2—2 thereof.
Figure 3:
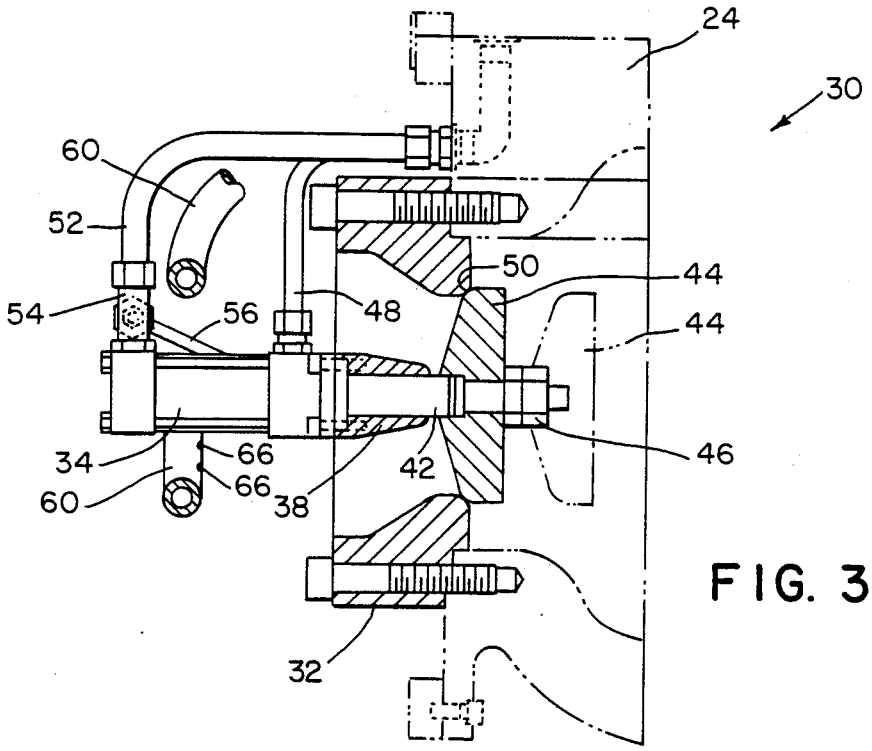
FIG. 3 is a fragmentary cross-sectional view through the prefill valve structure illustrated in FIG. 2, taken along the line 3—3 thereof.

Prefill valve 30 is shown in greater detail in FIGS. 2 and 3, and includes prefill housing 32, which is an annular ring that includes a central sleeve 38. As best seen in FIG. 2, prefill housing 32 includes a pair of radially inwardly extending arms 40 that support central sleeve 38 which, in turn, slidably supports a valve rod 42 to one end of which a prefill poppet 44 is firmly secured, as by means of threaded locking bolts 46 or the like. The end of valve rod 42 opposite to prefill poppet 44 is connected with the rod end of prefill actuating cylinder 34, which includes a double acting piston (not shown) for moving prefill poppet 44 from the closed position shown in FIG. 3 by solid lines to the open position shown in FIG. 3 by dashed lines. A conduit 48 provides pressurized hydraulic fluid to the rod end of prefill actuating cylinder 34, to move prefill poppet 44 into a closed position, relative to prefill valve aperture 50, and a head end conduit 52 provides pressurized hydraulic fluid to the opposite face of the piston, to move prefill poppet 44 away from prefill valve aperture 50, to thereby to permit flow of hydraulic fluid between reservoir 36 and the interior of clamp cylinder 24.

As best seen in FIG. 2, head end conduit 52 includes a tee 54 from which a pilot conduit 56 extends and is connected with a counterbalance valve 58. The counterbalance valve functions essentially as a pilot operated pressure relief valve, and has an outlet flow area substantially smaller than the flow area of prefill valve 30. An example of a suitable counterbalance valve is Sun cavity valve T-17A, manufactured by the Sun Hydraulics Corporation of Sarasota, Fla. Counterbalance valve 58 is preferably adjustable to permit variation of the rate of pressure release, as desired, and is carried in prefill valve housing 32. Valve 58 includes an inlet (not shown) that is in communication with the interior of clamp cylinder 24, and an outlet 59 that is connected with a sound muffler 60, defined by a closed chamber in the form of a tubular conduit that includes a closed distal end 62 spaced from outlet 59 of counterbalance valve 58. As shown, muffler 60 is a tubular structure that is generally U-shaped and includes a loop-shaped curved end portion 64 in the form of a circular arc that is substantially concentric with prefill valve rod 42. Muffler 60 includes a plurality of axially aligned, spaced apertures 66 that extend through the surface of muffler 60 that faces prefill housing 32. Apertures 66 are preferably circular, are substantially uniformly spaced from each other, and are so oriented that flow through the apertures is in the form of substantially parallel jets directed toward prefill housing 32, and toward the low pressure side of prefill poppet 44.

The hydraulic circuit associated with prefill valve 30 is shown schematically in FIG. 4, wherein the respective elements are identified with the same reference numerals as in the previously-described drawing figures. It can be clearly seen that the inlet to counterbalance valve 58 communicates with clamp cylinder 24 and outlet communicates with muffler 60. Additionally, pilot conduit 56 for the counterbalance valve communicates with head end conduit 52 that extends from prefill actuating cylinder 34.

In operation, and referring once again to FIG. 4, movable platen 18 is traversed rapidly toward fixed platen 70 by admitting pressurized hydraulic fluid into the rod ends of traverse cylinders 72 through conduits 74. While that rapid traverse of movable platen 18 takes place, prefill valve 30 is open to permit hydraulic fluid to flow from prefill reservoir 36 into clamp cylinder 24 so that the interior volume within clamp cylinder 24 to the right of clamp ram 22 (as viewed in FIG. 4) is continuously filled with hydraulic fluid as clamp ram 22 advances to the left, toward fixed platen 70. Such concurrent filling of clamp cylinder 24 while platen 18 is moving decreases the cycle time since it does not require a separate filling operation for filling the clamp cylinder after platen 18 has reached the leftmost position of its path of travel. When movable platen 18 has reached that position and mold sections 76 and 78 are in cooperative engagement, high pressure hydraulic fluid is introduced into rod end conduit 48 to cause prefill poppet 44 to engage with a valve seat defined by prefill valve aperture 50, and thereby close off the interior volume of clamp cylinder 24 from prefill reservoir 36. High pressure hydraulic fluid is then introduced into clamp cylinder 24 through high pressure conduit 80 to build up the pressure within clamp cylinder 24 in order to tightly hold mold sections 76 and 78 together while molten plastic is being injected into mold cavity 82 at a high pressure. The clamping force developed by the fluid pressure within clamp cylinder 24 can be several thousands of tons, depending upon the clamping force that is needed to maintain the mold sections in a closed condition while high pressure plastic injection is taking place.

When injection of the plastic material has been completed and the injected material has cooled and solidified to a sufficient extent to prevent flowback of plastic into the injection system, clamping pressure on the mold sections can be released. That pressure release is initiated by introducing high pressure hydraulic fluid into the head end conduit 52 of prefill actuating cylinder 34. Along with the introduction of the high pressure fluid to open prefill valve 30, that same pressure is exerted through pilot conduit 56 to actuate counterbalance valve 58, and causes the counterbalance valve to open immediately before the prefill valve to permit a small flow of high pressure fluid from cylinder 24 and thereby provide a rapid reduction in the hydraulic pressure within clamp cylinder 24. The pressure release is effected through counterbalance valve 58 and through muffler 60, with the released hydraulic fluid flowing through the counterbalance valve, into the muffler and through apertures 66 contained therein. When the high pressure in cylinder 24 has been substantially released, prefill valve 30 opens and the return movement of clamp ram 22, by the introduction of high pressure hydraulic fluid into the head ends of traverse cylinder 72 through conduits 84, pushes the hydraulic fluid within clamp cylinder 24 through prefill valve 30 and back into prefill reservoir 36, whereupon the cycle is repeated after the molded part is removed from the mold cavity.

It has been found that by providing a muffler of the type herein described, and directing the released fluid against a rigid surface that is incapable of substantial deflection, the objectionable decompression noise that normally accompanies the release of high hydraulic pressure from the clamp cylinder is significantly attenuated, and is brought to a lower, more reasonable level.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A method of reducing the intensity of sound resulting from rapid release of high hydraulic fluid pressure in a high pressure hydraulic system, said method comprising:

(a) gradually releasing a minor portion of the high pressure fluid in the high pressure portion of the fluid system to a low pressure reservoir through a valve communicating with the high pressure system on one side of the valve and communicating with the low pressure reservoir on the other side of the valve;

(b) conveying the released fluid into a closed end, elongated chamber positioned within the low pressure reservoir and having a plurality of spaced, small apertures to limit the rate of flow of pressurized fluid through the chamber so that a plurality of small jets of pressurized fluid issue from the chamber;

(c) directing the plurality of small jets against a rigid surface within the low pressure reservoir that is incapable of substantial deflection when the small jets impinge thereagainst; and (d) after the pressure level in the high pressure portion of the system has been reduced, rapidly releasing the remainder of the fluid from the high pressure portion of the system to the low pressure reservoir.

2. A method of reducing the sound intensity in a fluid system having a high pressure portion and a low pressure portion, wherein high pressure is released at a rapid rate into the low pressure portion, said method comprising:

(a) conveying a minor quantity of the high pressure fluid from the high pressure portion of the system to a low pressure reservoir;

(b) directing the minor quantity of the fluid into an apertured, closed end chamber positioned within the low pressure reservoir, the chamber having a plurality of spaced, small apertures distributed in a longitudinal direction along the surface of the chamber and sized to each release small quantities of the high pressure fluid in the form of small fluid jets;

(c) directing the small fluid jets against a rigid portion of the low pressure reservoir that is incapable of substantial deflection when fluid jets impinge thereagainst; and (d) after the pressure level in the high pressure portion of the system has been reduced, rapidly releasing the remainder of the fluid from the high pressure portion of the system to the low pressure reservoir.

3. A method as claimed in claim 2, wherein the apertured chamber is tubular and is U-shaped.

4. An hydraulic circuit for reducing the intensity of sound upon rapid release of hydraulic pressure from a high pressure level to a lower pressure level, said circuit comprising:

(a) reservoir means for containing low pressure hydraulic fluid and having high pressure hydraulic cylinder means communicating with the reservoir means;

(b) first valve means connecting the high pressure hydraulic cylinder means with the reservoir means, the first valve means being movable between an open position and a closed position to control flow between the cylinder means and the reservoir means;

(c) valve housing means defining a valve seat and having a predetermined flow area, the housing means engagable by the first valve means to selectively connect and disconnect the reservoir means with the high pressure hydraulic cylinder means and to permit a large volume of flow of hydraulic fluid between the cylinder means and the reservoir means;

(d) second valve means for providing communication between the cylinder means and the reservoir means, the second valve means having a smaller flow area than the flow area of the first valve means to permit pressure release through the second valve means; and (e) conduit means within the reservoir means, the conduit means extending from an outlet of the second valve means and terminating in a closed end spaced from the second valve means, the conduit means including a tube having a closed distal end and including a plurality of spaced apertures that extend in a longitudinal direction along the tube to provide communication between the second valve means and the reservoir means; and (f) operating means for opening the first valve means after the pressure in the high pressure hydraulic cylinder means has been reduced through the second valve means.

5. An hydraulic circuit as claimed in claim 4, wherein the reservoir means is at ambient pressure.

6. An hydraulic circuit as claimed in claim 4, wherein the valve housing means defines a portion of a wall of the reservoir means and of the cylinder means.

7. An hydraulic circuit as claimed in claim 4, wherein the first valve means includes a poppet valve.

8. An hydraulic circuit as claimed in claim 7, including second hydraulic cylinder means for moving the poppet valve into and out of contact with the valve seat to selectively open and close the first valve means.

9. An hydraulic circuit as claimed in claim 4, wherein the conduit means is a tube.

10. An hydraulic circuit as claimed in claim 9, wherein the tube is U-shaped.

11. An hydraulic circuit as claimed in claim 4, wherein the conduit means includes a loop.

12. An hydraulic circuit as claimed in claim 4, wherein the conduit means is oriented so that the apertures face a rigid structure to cause high pressure fluid passing therethrough to impinge upon the rigid structure.

13. An hydraulic circuit as claimed in claim 12, wherein the rigid structure is the first valve means.

* * * * *